US005171102A

United States Patent [19]

De Wit

[11] Patent Number: 5,171,102

[45] Date of Patent: Dec. 15, 1992

[54] WIER CONSTRUCTION

[75] Inventor: Wilhelmus G. J. De Wit, Houten, Netherlands

[73] Assignee: Waterschap Kromme Rijn, Houten, Netherlands

[21] Appl. No.: 771,335

[22] Filed: Oct. 4, 1991

[51] Int. Cl.[5] ..... E02B 7/44

[52] U.S. Cl. ..... 405/101; 405/100; 405/87

[58] Field of Search ..... 405/100, 101, 87, 92, 405/99; 251/326, 328, 300, 301

[56] References Cited

U.S. PATENT DOCUMENTS

| | | | |
|---|---|---|---|
| 2,051,359 | 8/1936 | Adams | 405/101 |
| 2,055,192 | 9/1936 | Becher | 405/101 |
| 2,759,697 | 8/1956 | Harza | 405/100 X |
| 4,103,497 | 8/1978 | Colamassi et al. | 405/101 X |
| 4,455,106 | 6/1984 | Johnson | 405/101 X |

FOREIGN PATENT DOCUMENTS

| | | | |
|---|---|---|---|
| 312509 | 11/1973 | Austria . | |
| 758796 | 12/1943 | Fed. Rep. of Germany . | |
| 0015712 | 1/1982 | Japan | 405/100 |
| 8702118 | 4/1989 | Netherlands . | |

*Primary Examiner*—Dennis L. Taylor
*Attorney, Agent, or Firm*—Bachman & LaPointe

[57] ABSTRACT

A weir construction has a weir gate which is tiltable around an axis suspended in a canal section above the bottom thereof, whereby the axis is situated between, and at a distance from, the lower and the upper edge of the weir gate closer to the lower edge of the weir gate than to the upper edge thereof, which weir gate cooperates with a floating counterweight for opening and closing thereof by rotation around the axis. In order to obtain an improved sealing of the weir gate and the canal section, a flexible seal strip is provided between the lower edge of the weir gate and the bottom of the canal section, which seal strip allows curvilinear movement of the weir gate lower edge and prevents flow of water between the lower edge of the weir gate and the bottom of the canal section.

12 Claims, 3 Drawing Sheets

WIER CONSTRUCTION

BACKGROUND OF THE INVENTION

The invention concerns a weir construction comprising a weir gate which is tiltable around an axis suspended in a canal section above the bottom thereof, whereby said axis is situated between. and at a distance from, the lower and the upper edge of the weir gate closer to the lower edge of the weir gate than to the upper edge thereof. which weir gate cooperates with control means for opening resp. cloging thereof by rotation around said axis.

Such weir constructions are generally known, e.g. from Dutch patent application NL-A-8702118. This type of weir construction comprises a weir gate allowing the water to flow both over and under the gate when it is opened. The weir gate is opened under the influence of the water pressure, as well as of control means such as a floating counter weight which is connected to the weir gate.

In its closed position, the weir gate lower edge should provide a seal with respect to the bottom of the canal section. However, this sealing action may be impaired by obstacles transported by the stream, such as sand, stones or dirt such as wood or water plants. In case these obstacles get stuck between the weir gate and the bottom of the canal section, the sealing action between weir gate lower edge and bottom is lost.

SUMMARY OF THE INVENTION

In an attempt to prevent the malfunction of the weir construction, grades are fitted. However, these grades may get fouled as well, which brings about the necessity to clean them frequently. The object of the invention is therefor to afford a weir construction which lacks these disadvantages. This object is achieved in that flexible seal means are provided between the lower edge of the weir gate and the bottom of the canal section, which seal means allow the curvilinear movement of the weir gate lower edge and prevent the flow of water between the lower edge of the weir gate and the bottom of the canal section.

In the weir construction according to the invention, it is no longer possible for rocks or wood or water plants to get stuck between the weir gate lower edge and the bottom of the canal section. Furthermore, a perfect sealing action is obtained, without increasing friction. This sealing action is always maintained when the weir gate is in its opened condition, in which the water only flows over the upper edge of the gate.

Preferably, the flexible seal means comprise a strip of flexible material, one side of which strip being sealingly connected to the lower edge of the weir gate, and the other side of which being sealingly connected to a support plate situated near the lower edge of the weir gate, the distance between said support plate and said lower edge being always smaller than the dimension of the strip between said sides. The strip may comprise any suitable material which is strong enough to withstand the water pressure. The strip may be armed with a suitable core material.

In this embodiment, the part of the strip near its connection to the support plate is pressed against said plate under influence of the water pressure, whereas the rest of the strip extends towards the lower edge of the weir gate depending on the angular position of said weir gate, in such a way that the strip unrolls from the support plate upon rotation on the weir gate in its direction of opening vice versa. The loadings on the strip are reduced because of the supporting action of the support plate. Furthermore, by selecting a suitable form for the support plate, and thus for the distance between the weir gate lower edge and said support plate, the dynamic characteristics of the weir gate may be influenced.

For instance, the weir gate may be provided with a generally neutral behaviour. This means that the forces acting on the gate are linearly dependent on the angle of opening of the weir gate. To that end, the support plate, in a plane perpendicular to the axis, is curved generally along the trajectory described by the lower edge of the weir gate upon rotation thereof. A perfect neutral behaviour however is obtained if the support plate, at least in the area of contact with the strip, is concentrical with respect to the weir gate axis.

However, by providing a support plate which, at least in the area of contact with the strip is non-circular, a progressive or regressive tilting behaviour may be obtained. For instance, in case the distance between the support plate and the lower edge of the weir gate increases, in the direction of opening the weir gate, the restoring forces increase. This means, that due to the shape of the support plate the weir gate opens less far in comparison with a weir gate with a neutral behaviour.

If, on the contrary, said distance decreases upon opening of the weir gate, it will open further than a neutral weir gate.

Other shapes for the support plate are possible as well. According to a relatively simple embodiment, the support plate in a plane perpendicular to the axis consists of an angle profile, one leg of which being horizontal and the other leg being vertical in such a way that the inner corner of the profile is facing the lower edge of the weir gate.

According to a preferred embodiment, the axis of the weir gate is suspended in a frame which is adjustable in a vertical direction. The support plate being also suspended in the frame and being sealingly connected to the bottom of the canal section. The vertical adjustability of the weir gate offers a wide rang of adjustment of the upstream water level.

In said embodiment, a treshold plate is provided which is pivotably connected to the lower edge of the support plate as well as to the bottom of the canal section. The treshold plate together with the support plate and flexible strip represent the seal between the weir gate lower edge and the bottom of the canal section. When the position of the weir gate is adjusted in vertical direction, said support plate and treshold plate pivot with respect to each other and with respect to the weir gate in case the support plate is provided with arms which are pivotable around the weir gate axis, and the pivot axis between the support plate and the treshold plate is situated outside the plane containing the pivot axis between the treshold plate and the bottom of the canal section. and the weir gate axis.

BRIEF DESCRIPTION OF THE DRAWINGS

The invention is described in conjunction with the drawings in which.

DETAILED DESCRIPTION

Figure 1:
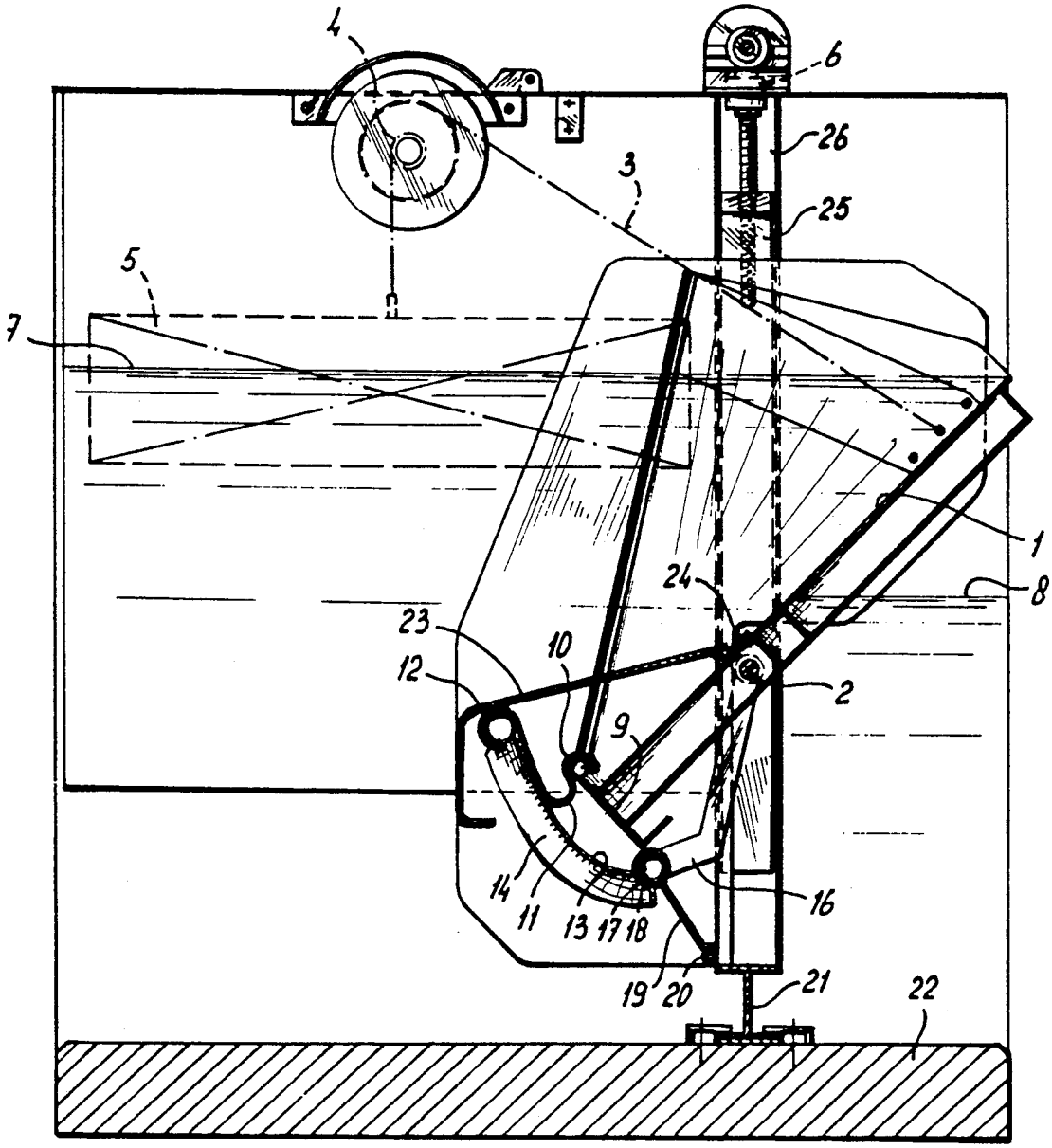
FIG. 1 shows a cross section of the weir in longitudinal direction of the canal.

As shown in FIG. 1, the weir gate (1) is pivotably suspended on the shaft (2). The weir gate (1) is held upright against the hydraulic pressure by means of cable (3) transmission (4) and floating counterweight (5). By means of the spindle constructions (6), provided on both sides of weir gate (1), the shaft (2) may be adjusted vertically. Spindle constructions (6) are connected to frame members (25), which are slidable in grooves (26) provided on each side in the canal. In this way the upstream weir level (7) can be controlled. The downstream weir level (8) has some influence on the correct adjustment and the behaviour of the weir.

Figure 3:
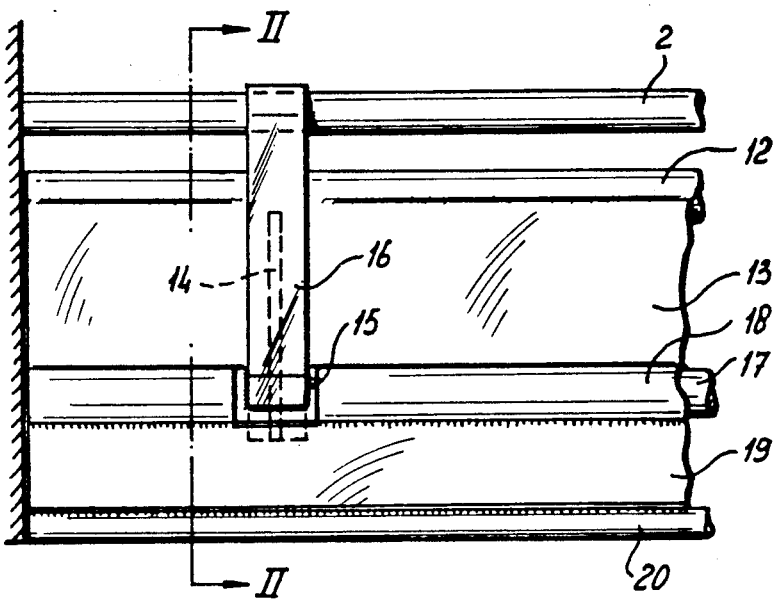
FIG. 3 shows a detail of the connection between the support plate and treshold plate, from the downstream side, of whereby the weir gate and the protection plate have been omitted.

The lower edge (9) of weir gate (1) has an attachement (10) for a flexible strip (11), the other side of which is attached to the upper edge (12) of a support plate (13) with reinforcing strips (14). The support plate (13) is welded to arms (16). The arms (16) are rotatably suspended on the shaft (2) of the weirgate (1). Shaft (17) runs through the bearing sleeves (15) welded on arms (16), see FIGS. 3 and 4. This shaft (17) carries, through bearing sleeves (18), a treshold plate (19). The treshold plate (19) is at (20) pivotably attached to a treshold beam (21) fixed to the bottom of the canal.

Support plate (13) serves to support the flexible strip (11), and is stiffly connected to arms (16). Because the support plate (13) by means of arm (16) is suspended on the shaft (2) of the weirgate (1), the position of the support of the flexible strip (11) in relation to the lower edge (9) of the weirgate (1) will not change when the spindle construction (6) is used to adjust the shaft (2) of the weirgate (1).

Because the flexible strip (11) extends between the support plate (13) and the lower edge (9). the distance between the support plate (13) and the lower edge (9) is decisive for the resultant of the hydrostatic forces exerting on the unsupported areas of the flexible strip (11). When the support plate (13) and the lower edge (9) of the weirgate (1) are both circular formed with axis (2) as centre, the influence of the flexible strip (11) on the tilting movement is neutral. By changing the profile of the support plate (13) and/or the lower edge (9) a progressive or regressive tilting character can be attained; see FIG. 4.

Figure 4:
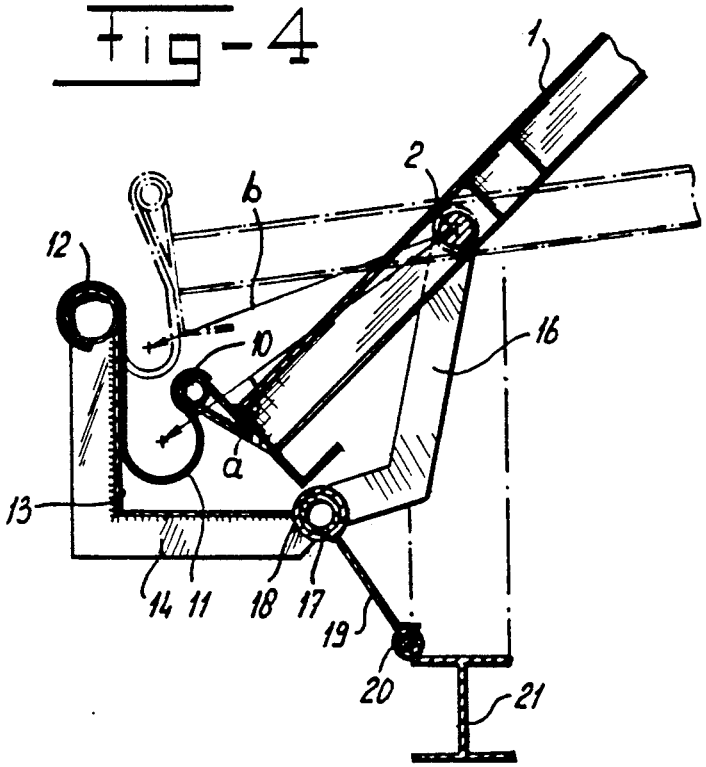
FIG. 4 shows an alternative embodiment of the support plate and the lower edge of the weir gate.

FIG. 4 furthermore clarifies the influence of strip (11), support plate (14) and lower edge (9) on the tilting character of weir gate (1). In the position of weir gate (1) with solid lines, the moment-arm of the hydrostatic forces exerted on strip (11) with respect to axis (2) is a. In the position with chain-dotted lines, said moment-arm is shorter, i.e. b. In said latter position therefore, the restoring moment exerted by strip (11), which tries to tilt weir gate (1) to the upright position, is smaller.

Said effect is beneficial in that it compensates the growth of the restoring forces exerted on weir gate (1) when moving towards a more horizontal position, and exerted thereon by the lower level. The phenomenon of an increasing restoring force when tilting towards a more horizontal position is quite well known. However until the present embodiments it was not possible to eliminate said phenomenon.

Figure 2:
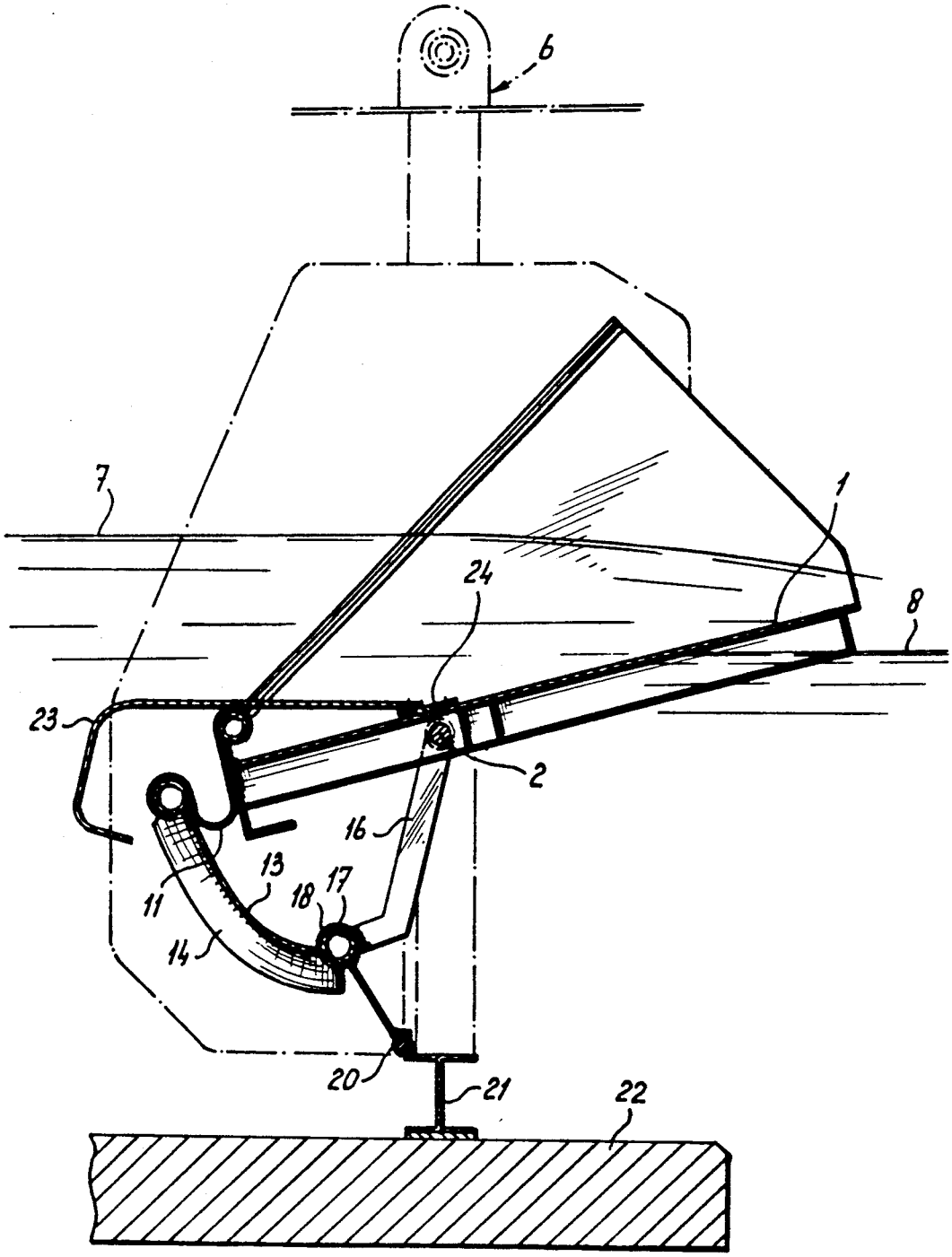
FIG. 2 shows a similar cross section of the weir in another position; according to II—II of FIG. 3.

As shown in FIGS. 1 and 2, a protection plate (23) is hinged or flexibly attached to the weirgate (1) at (24). Plate (23) reaches over the attachement (12) of the flexible strip (11) and prevents dirt accumulation on the flexible strip (11).

With the construction according to the invention a weir is realised where the lower edge (9) of the weirgate (1) is sealingly connected with the threshold beam (21) on the bottom of the canal, without having any extra frictional losses. The tilting effect of the weirgate (1) is not negatively influenced. With the help of the flexible strip (11) and the profile of the support plate (13) and/or the profile of the lower edge (9) of the weirgate (1), a proper functioning of the weir for obtaining the desired waterlevel is possible.

It is to be understood that the invention is not limited to the illustrations described and shown herein, which are deemed to be merely illustrative of the best modes of carrying out the invention, and which are susceptible of modification of form, size, arrangement of parts and details of operation. The invention rather is intended to encompass all such modifications which are within its spirit and scope as defined by the claims.

I claim:

1. Weir construction, comprising: a weir gate which is tiltable around an axis suspended in a canal section above the bottom thereof, said axis being situated between, and at a distance from, a lower edge and an upper edge of said weir gate, said axis being closer to said lower edge than to said upper edge; control means which cooperate with said weir gate to open and close said weir gate by rotation about said axis; flexible seal means disposed between said lower edge of said weir gate and the bottom of said canal section, said seal means allowing curvilinear movement of said lower edge of said weir gate and preventing flow of water between said lower edge of said weir gate and the bottom of said canal section; and support means for supporting said seal means, said support means being situated opposite and along a curvilinear trajectory of said lower edge of said weir gate so that said seal means are supported at a side of said support means facing said lower edge of said weir gate.

2. Weir construction according to claim 1, wherein the flexible seal means comprise a strip of flexible material, one side of which strip being sealingly connected to the lower edge of the weir gate, and the other side of which being sealingly connected to a support plate situated near a lower edge of the weir gate, a distance between said support plate and said lower edge being always smaller than the dimension of the strip between said sides.

3. Weir construction according to claim 2, wherein a part of the strip near its connection to the support plate is pressed against said plate under influence of water pressure, and the rest of the strip extends towards the lower edge of the weir gate depending on an angular position of said weir gate, in such a way that the strip unrolls from the support plate upon rotation of the weir gate in its direction of opening vice versa.

4. Weir construction according to claim 3, wherein the support plate in a plane perpendicular to the axis is curved generally along the trajectory described by the lower edge of the weir gate upon rotation thereof.

5. Weir construction according to claim 4, wherein the support plate, at least in the area of contact with the strip, is concentrical with respect to the weir gate axis.

6. Weir construction according to claim 4, wherein the support plate, at least in the area of contact with the strip, is non-circular.

7. Weir construction according to claim 3, wherein the support plate in a plane perpendicular to the axis consists of an angle profile, one leg of which being horizontal and the other leg being vertical in such a way that the inner corner of the profile is facing the lower edge of the weir gate.

8. Weir construction according to claim 3, wherein the strip is connected to the uppermost edge of the support plate, as well as to a projecting edge at the lower edge of the weir gate.

9. Weir construction according to claim 1, wherein the axis is suspended in a frame which is adjustable in vertical direction, the support plate being also suspended in the frame and being sealingly connected to the bottom of the canal section.

10. Weir construction according to claim 9, wherein a treshold plate is provided which is pivotably connected to the lower edge of the support plate as well as to the bottom of the canal section.

11. Weir construction according to claim 10, wherein the support plate is provided with armc which are pivotable around the weir gate axis, and the pivot axis between the support plate and the treshold plate is situated outside the plane containing the pivot axis between the treshold plate and the bottom of the canal section, and the weir gate axis.

12. Weir construction according to claim 2, wherein a protection plate is pivotably connected to the weir gate, which protection plate rests on the support plate.

* * * * *